US006637220B1

(12) United States Patent
Sheehan

(10) Patent No.: US 6,637,220 B1
(45) Date of Patent: Oct. 28, 2003

(54) DILUTION CYCLE FOR ABSORPTION CHILLER

(75) Inventor: Darren S. Sheehan, West Hartford, CT (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/207,538

(22) Filed: Jul. 29, 2002

(51) Int. Cl.[7] ..... F25B 15/00

(52) U.S. Cl. ..... 62/141; 62/148; 62/476; 62/101; 62/104; 62/489

(58) Field of Search ..... 62/141, 148, 476, 62/101, 104, 489

(56) References Cited

U.S. PATENT DOCUMENTS 3,556,200 A * 1/1971 Leonard, Jr. ..... 165/2
4,487,026 A * 12/1984 Alfano ..... 62/101
5,477,696 A * 12/1995 Takahata et al. ..... 62/148
5,586,447 A * 12/1996 Sibik et al. ..... 62/141
5,724,823 A * 3/1998 Martini et al. ..... 62/148
5,816,070 A * 10/1998 Meckler ..... 62/476
6,038,882 A * 3/2000 Kuroda et al. ..... 62/476
6,260,364 B1 * 7/2001 Moon et al. ..... 62/141
6,430,942 B1 * 8/2002 Cummins ..... 62/112

* cited by examiner

*Primary Examiner*—William C. Doerrler
*Assistant Examiner*—Mark Shulman
(74) *Attorney, Agent, or Firm*—Wall Marjama & Bilinski LLP

(57) ABSTRACT

A routine of controlling the dilution cycle of an absorption chiller to determine when to initiate a dilution cycle, continue the cycle and terminate the cycle. The concentration of solution leaving the chiller's low temperature generator is calculated and the crystallization temperature of the solution is then determined. The crystallization temperature is compared to the ambient temperature and the result is used to determine whether to institute a dilution cycle, continue the cycle or terminate the cycle.

7 Claims, 1 Drawing Sheet

DILUTION CYCLE FOR ABSORPTION CHILLER

FIELD OF THE INVENTION

This invention relates to absorption refrigeration and, in particular to a dilution cycle for use in an absorption chiller.

BACKGROUND OF THE INVENTION

Dilution cycles are run in absorption chillers to lower the refrigerant concentration in the absorbent solution so that the solution does not crystallize as the solution temperature approaches the ambient temperature. The lower the solution concentration, the lower the solution temperature can be at shut down without having to be concerned with crystallization. However, the lower the solution concentration at shut down, the longer it will take to reconcentrate the solution to an operating level at start up.

For example, in many chillers in present day use the dilution cycle is accomplished by first shutting down the heater used to raise the temperature in the upper or high temperature stage generator of the machine. The solution and refrigerant pumps as well as the chilled water and condenser water pumps, however, are allowed to continue to run for a given predetermined period time after the heat to the generator is terminated. The preset time interval generally must be relatively long in order to dilute highly concentration solution in the event the machine is operating under full load at the time of shut down. Correspondingly, when the machine is shut down when operating under a partial load, the preset time period allows the solution to become overly diluted thus requiring a relatively long time to reconstitute the solution at start up. As can be seen, the use of a predetermined dilution time cycle can cause the machine to run longer than necessary at shut down or can extend the time necessary to reconcentrate the solution when the chiller is restarted. In either case, this type of dilution cycle can cause a good deal of energy to be wasted during both shut down and start up.

SUMMARY OF THE INVENTION

It is a primary object of the present invention to improve dilution cycles used in absorption chillers.

It is a further object of the present invention to save energy during the shut down and restarting of an absorption machine.

Another object of the present invention is to provide a dilution cycle control that is able to determine how long the cycle must run at shut down in order to safely shut down the machine.

A still further object of the present invention is to control the dilution cycle of an absorption chiller in response to the crystallization temperature of the solution and the ambient temperature at shut down.

Yet another object of the present invention is to provide a highly efficient dilution cycle for use in an absorption chiller that employs a versatile shut down routine that is suitable for use regardless of the cause of the machines shut down.

These and other objects of the present invention are attained by a routine for controlling the dilution cycle of an absorption chiller that determines when the dilution cycle is to be initiated, continued and terminated. The concentration of solution leaving the low temperature generator of the chiller is first calculated and from this calculation the crystallization temperature of the solution is determined.

The crystallization temperature is compared to the ambient temperature surrounding the chiller and, based upon the comparison, a determination is made whether to initiate a dilution cycle or to continue the cycle once it has started, and lastly when to terminate the cycle in order to conserve energy without endangering the chiller.

BRIEF DESCRIPTION OF THE DRAWING

For a further understanding of these and objects of the invention, reference will be made to the following detailed description of the invention which is to be read in connection with the accompanying drawing.

DETAILED DESCRIPTION OF THE INVENTION

Figure 1:
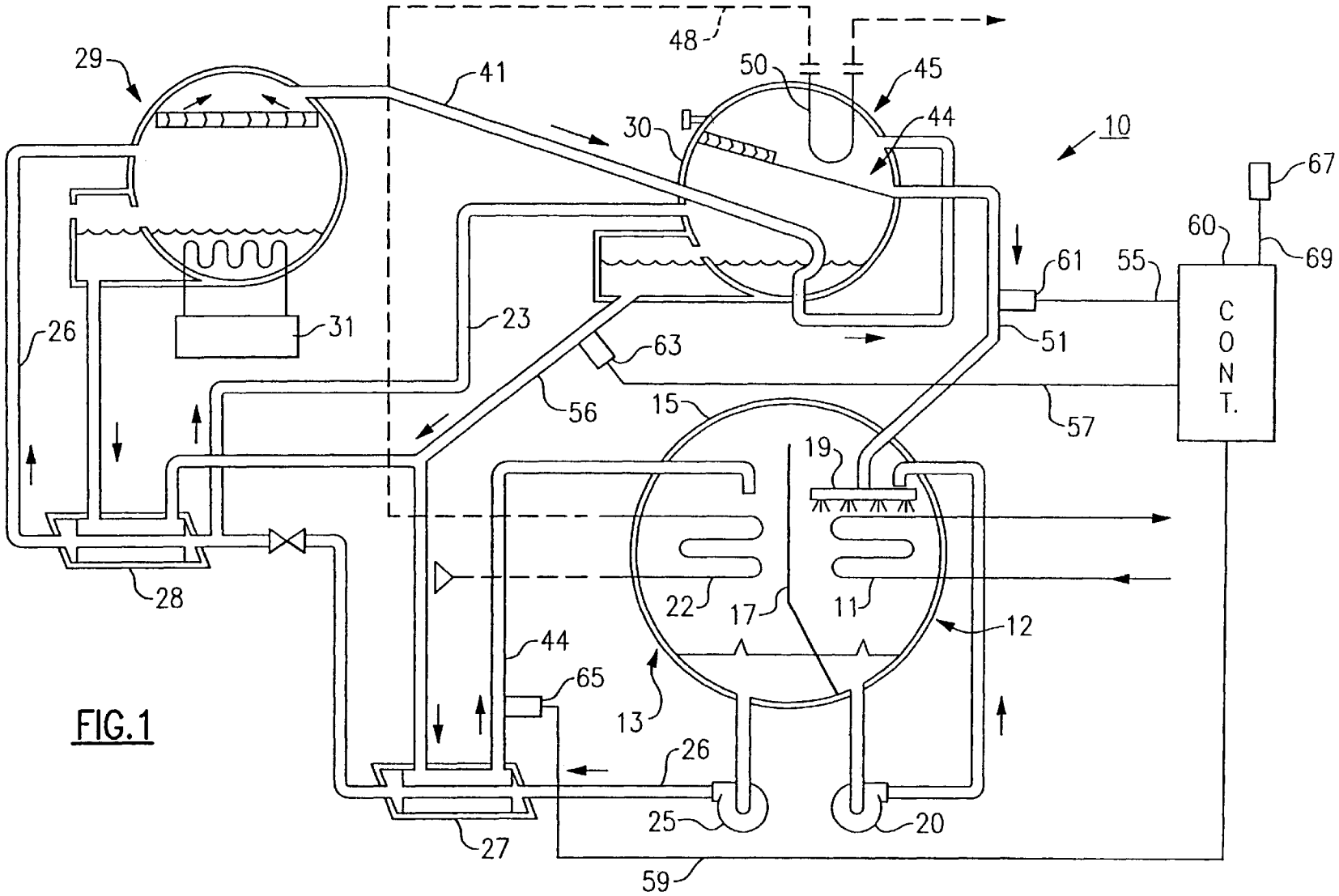

Turning now to the drawing there is illustrated a two stage absorption chiller, generally referenced 10, that embodies the teachings of the present invention. Although the present invention will be described with particular reference to a two stage machine it should be clear from the disclosure below that the invention has wider application and can be employed in any type of chiller that is either direct fired or indirect fired, a single stage machine or a multiple stage machine having either a series or a parallel solution flow circuit.

The present machine is arranged to chill water or any other suitable liquid that is passed through the tubes of a chilled water heat exchanger 11 that is located in the evaporator section 12 of the machine. The evaporator and the systems absorber 13 are mounted together in a single shell 15 in a side by side alignment. The evaporator section is separated from the absorber section by a truncated wall 16 that extends longitudinally along the length of the shell.

The present chiller may employ water as a refrigerant and lithium bromide as an absorbent, however, any other suitable combination of refrigerants and absorbents may also be used without departing from the teachings of the present invention. A high vacuum is maintained within the shell 15 that houses the evaporator and absorber sections of the chiller. As will be explained in greater detail below, liquid refrigerant developed in the absorption process is delivered into the evaporator and is sprayed via header 19 over the tubes of the heat exchanger 11 whereby the water being chilled gives up heat to the refrigerant.

A portion of the refrigerant is flash cooled to a vapor and the vapor passes over the truncated wall into the absorber. The absorber is partially filled with lithium bromide which absorbs the refrigerant vapor to create a solution made up of the two components at various concentration levels depending on the chiller load conditions.

Liquid refrigerant that is collected in the sump of the evaporator is drawn off by a refrigerant pump 20 and is recirculated through the refrigerant spray header 19. The heat that is developed in the absorber is carried off by cooling water that is passed through the tubes of the absorber heat exchanger 22. Although not shown, a cooling tower is typically placed in the cooling water circuit whereby the heat carried off by the cooling water is rejected into the surrounding ambient.

The term weak solution will be used herein to identify solution that has a high concentration of refrigerant while the term strong solution will be used to identify a solution that has a relatively low concentration of refrigerant. For a two stage machine as herein described the concentration of lithium bromide in the solution is generally maintained between 56 and 63% depending upon the chillers load conditions. Operating the machine above 63% at relatively high temperatures will cause the lithium bromide to crystallize when it is allowed to cool as for example during shut down. Dilution cycles, as noted above, have been devised to prevent crystallization from occurring during shut down.

Weak solution which is rich in refrigerant is drawn from the absorber by a solution pump 25. The solution is initially passed in series via a solution delivery line 26 through a low temperature solution heat exchanger 27 and a second high temperature heat exchanger 28 prior to being delivered into a first stage high temperature generator 29. A portion of the weak solution leaving the low temperature heat exchanger is diverted by a shunt line 23 to a second stage low temperature generator 30. The weak solution that is moving through the shell side of the two solution heat exchangers is placed in heat transfer relation with higher temperature strong solution that is being returned via the solution return line 44 from the two system generators to the absorber thus raising the temperature of the weak solution.

The weak solution that enters the high temperature generator is further heated by a burner 31 that is fired by any suitable fuel such as gas or oil. Although a fuel fired burner is herein employed, it should be clear that any other suitable heating means may be utilized in the practice of the invention provided that the heat output can be varied to satisfy the load demands placed on the machine. The burner serves to raise the temperature of the solution in the generator to a level such that a portion of the refrigerant is taken out of solution in the form of a vapor. The refrigerant vapor produced in the high temperature generator is passed through the low temperature generator 30 via a vapor line 41 prior to being introduced into the systems condenser 43.

The low temperature generator is housed in a shell 44 along with the condenser. As the refrigerant vapor passes through the low temperature generator it gives up heat to the solution on the shell side of the generator to heat the solution to a level wherein refrigerant is released from the solution in the form of a vapor while at the same time a portion of the refrigerant in the vapor line is condensed. The now strong solution in the low temperature generator is returned through the shell side of the low temperature heat exchanger to the absorber along with the strong solution from the high temperature generator.

Cooling water from the absorber is passed through the tubes of a condenser heat exchanger 50 prior to returning to the cooling tower. Accordingly, a portion of the refrigerant in the condenser is reduced to a liquid and is collected in the sump of the condenser. This liquid, in turn, is gravity fed via return line 51 to the evaporator spray header 19 and passed over the tubes of the evaporator heat exchanger to complete the refrigeration cycle.

The operation of the chiller is controlled by a programmable controller 60 as is well known in the art. As part of the control sequence, a chiller shut down procedure is initiated which includes a dilution cycle that insures that the solution in the machine will not crystallize as the machine temperature is brought down to the ambient temperature. As noted above, one dilution cycle involves turning off the supply of fuel to the burner or heater in the high temperature generator while allowing the solution and refrigerant circulation pump to continue to operate for a preset period of time sufficient to bring the solution concentration down to a level at which the solution will not crystallize at ambient temperatures.

The present invention involves a control routine that can be utilized in conjunction with this type of time delay dilution cycle and other dilution cycles to minimize energy consumption during the cycle and again during reconstitution of the solution during a restart.

The controller is programmed to begin the dilution control routine once the controller instructs the chiller to shut down. The cause of a shut down could include, but is not limited to alarm shut downs, recycle shut downs or manual shut downs. The dilution routine does not have to begin immediately at shut down but may be commenced sometime after the dilution cycle has begun.

Initially the temperature of the refrigerant leaving the system condenser 45 is measured by a temperature sensor 61 that is mounted in the refrigerant return line 51. This information is forwarded to the controller 60 via data line 55 for use in the dilution control routine. At the same time, the temperature of the solution leaving the low temperature generator 30 is measured by a temperature sensor 63 mounted in the solution return line 56 and sent to the controller by data line 57. From these temperature measurements, the concentration of the solution leaving the low temperature generator can be calculated in the controller which is programmed to perform the calculation.

In the event the concentration of the solution is less than a preselected concentration level, the controller will terminate the dilution cycle if started or prevent the cycle from commencing if it has not been started. The preselected value is chosen so that the solution concentration is well outside the range at which crystallization poses a danger during shut down. If the solution concentration is found to be greater than the preselected concentration, the dilution cycle is continued if it has begun or the cycle is started if not previously started.

From the calculated concentration and other preprogrammed data, the crystallization temperature of the solution can be easily found and this information is stored in the dilution routine program.

While the dilution cycle is operating, the temperature of the solution returning from the shell side of the low temperature heat exchanger 27 via line 44 is measured by a further temperature sensor 65 and this information is sent to the controller via data line 59. It should be noted that the solution concentration at this location is the same as the concentration of the solution leaving the low temperature generator. The ambient temperature surrounding the chiller is also taken by at least one temperature sensor 67 and this information is also sent to the controller by data line 69. Preferably, a number of temperature reading can be taken about the chiller and the average temperature applied to the controller. The controller is programmed to calculate the difference between the ambient temperature measurement and the solution temperature measurement. If the temperature difference is below a preprogrammed valve indicating that there is a danger of crystallization, the dilution cycle is continued or if not started is initiated.

The concentration of the solution is continued to be monitored by the routine as well as the ambient temperature and the solution temperature as described above until such time as the temperature difference between the ambient and solution temperature exceeds the preprogrammed valve at which time the dilution cycle is terminated.

Upon termination of the dilution cycle, the routine will check to see if the chiller has been told to restart. If so the dilution routine is exited and the restart procedure is commenced.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A dilution control routine for determining whether a dilution cycle should be initiated, continued or terminated upon the shutting down of an absorption chiller system, said routine including the steps of:

a) calculating the concentration of solution being returned to the system absorber at the time of shut down, b) initiating or continuing the chiller's dilution cycle in the event the calculated solution concentration is above a predetermined concentration level, c) calculating the crystallization temperature of the solution being returned to the absorber, d) measuring the temperature of the solution being returned to the absorber, e) measuring the ambient temperature in the vicinity of the chiller, f) calculating the difference between the two measured temperatures, g) continuing the dilution cycle in the event the temperature difference is below a given temperature value, and h) terminating the dilution cycle in the event the temperature difference is above a given temperature value.

2. The method of claim 1 that includes the further step of terminating the dilution cycle once it has been initiated in the event the solution concentration calculated in step a) is below said predetermined concentration.

3. The method of claim 2 that includes the further step of checking periodically to ascertain if the chiller has been instructed to restart and if so existing the control routine.

4. The method of claim 1 that includes the further steps of i) measuring the temperature of refrigerant being delivered to the system evaporator and the temperature of the strong solution being returned to the system absorber and using the temperature information to calculate the concentration of solution being returned to the absorber.

5. The method of claim 1 wherein said solution temperature is measured in the return line of a low temperature solution heat exchanger that returns strong solution to the absorber.

6. The method of claim 1 wherein the ambient temperature is measured at a number of locations adjacent the chiller and an average of the measured temperature is used in step e).

7. The method of claim 4 wherein temperature of the refrigerant is measured in a line returning the refrigerant from the low temperature condenser stage to the evaporator.

* * * * *